United States Patent [19]

Komiyama et al.

[11] 4,292,074

[45] Sep. 29, 1981

[54] WEAR RESISTANT ALLOY

[75] Inventors: Yoshiro Komiyama, Okazaki; Katsumi Kondo, Toyota; Yoshio Fuwa, Toyota; Akira Matsui, Toyota; Shoji Miyazaki, Toyota; Tokushiro Hasegawa, Ootsu, all of Japan

[73] Assignee: Toyota Jidosha Kogyo Kabushiki Kaisha, Aichi, Japan

[21] Appl. No.: 71,578

[22] Filed: Aug. 31, 1979

Related U.S. Application Data

[63] Continuation-in-part of Ser. No. 970,968, Dec. 19, 1978, abandoned, which is a continuation of Ser. No. 835,970, Sep. 28, 1977, abandoned.

[30] Foreign Application Priority Data

May 24, 1977 [JP] Japan ..... 52-60064

[51] Int. Cl.[3] ..... C22C 30/00

[52] U.S. Cl. ..... 75/122; 75/134 F; 75/170; 75/171

[58] Field of Search ..... 75/122, 134 F, 170, 75/171

[56] References Cited

U.S. PATENT DOCUMENTS 2,507,698 5/1950 DuBois ..... 75/134 F

*Primary Examiner*—R. Dean

*Attorney, Agent, or Firm*—Stevens, Davis, Miller & Mosher

[57] ABSTRACT

A wear resistant alloy having the composition of 30%-60% Ni, 6%-10% Si, 0.5%-3% B, 0.5%-2% C, 2%-8% carbide and boride forming element selected from Cr, Mo, and W, and 30%-60% Fe, wherein Si and B form silicides and borides, respectively, of Ni and Fe of the desirable density to provide a good balance between hardness, strength, fusibility, grindability, brittleness, etc. of the material, and to maintain its melting point as low as possible and to allow for good self-fluxing characteristic and moldability.

1 Claim, 5 Drawing Figures

WEAR RESISTANT ALLOY

CROSS-REFERENCE TO RELATED APPLICATION

The present application is a continuation-in-part of U.S. patent application No. 970,968, now abandoned which was a continuation of U.S. patent application Ser. No. 835,970, also now abandoned.

BACKGROUND OF THE INVENTION

The present invention relates to a wear-resistant alloy.

In overhead camshaft internal combustion engines a valve rocker arm such as 1 shown in FIG. 1 is often incorporated for transmitting the rotational movement of a camshaft to an intake or exhaust valve so as to reciprocate it. The valve rocker arm has a pad face 2 at its one end portion which contacts the cam lead face of the camshaft and is driven thereby. Therefore it is desired that the pad face should have high wear resistance and tenacity.

Because of this, there have been proposed various special materials for use as the pad face, or various surface treatments to be applied to the surface of the pad face, such as chromium plating, chilling of cast iron, nitriding, etc. However, these conventional treatments have not yet provided satisfactory results. Chromium plating is liable to exfoliate in use, while chilling of cast iron and nitriding are not satisfactory with regard to wear resistance.

In recent years, it has become known to spray wear resistant alloy such as stellite and self-fluxing alloy by the spray-fuse process onto the pad face, or to make the pad face portion out of a low cast iron including small amounts of Cr, Mo, etc.. However, these conventional materials appear to be unable to match up to ever-increasing requirements for the pad faces of valve rocker arms.

SUMMARY OF THE INVENTION

It is therefore the object of the present invention to provide a material for making the pad face of a valve rocker arm which itself has high wear resistance and yet causes lesser wear of a co-operating member and further has good workability, low melting point, and good self-fluxing characteristic.

According to the present invention, the aforementioned object is accomplished by a wear-resistant alloy consisting essentially of about 30%–60% Ni, 6%–10% Si, 0.5%–3% B, 0.5%–2% C, 2%–8% carbide and boride forming element selected from Cr, Mo, and W, and 30%–60% Fe.

The abovementioned composition was found to be good for the following reasons:

If Ni content is less than 30%, workability and grindability of the alloy is seriously reduced, while, on the other hand, if Ni content exceeds 60%, wear resistance of the alloy deteriorates. Therefore, the Ni content is desired to be in the range 30%–60%.

As Si content increases, the amount of silicides formed with Ni and Fe increases, whereby hardness and wear resistance of the alloy increase. On the other hand, however, the alloy becomes brittle, i.e. its impact value decreases.

If Si content is less than 6%, generation of the Ni-Fe silicides is insufficient, so that the micro-Vicker's hardness becomes as low as 400, thereby resulting in poor wear resistance. If Si content exceeds 10%, although the alloy becomes harder, it becomes too brittle, and becomes more liable to suffer cracking in grinding as well as in use, thereby causing damage such as pitting, scuffing, etc.. Therefore Si content is desired to be 6%–10%.

B is incorporated in the alloy as solid solution and also generates borides with Fe, Ni, and Cr, or similar elements such as Mo and W. The borides thus generated and B incorporated in the alloy as solid solution increase strength of the alloy. Further, B, when it exists with Si in the alloy, lowers melting temperature of the alloy and gives the alloy self-fluxing characteristic. If the amount of B is too small, generation of borides is insufficient, so that the alloy is given no effective increase of hardness and no effective self-fluxing characteristic. On the other hand, if the amount of B is too large, impact value of the alloy lowers too much, with simultaneous deterioration of grindability and generation of scuffing. In view of these and in accordance with the results of experiment explained later, B content should be in the range 0.5%–3%.

C generates carbides together with Cr, Mo, and W, and thereby increases hardness of the alloy. However, if its content is less than 0.5%, no effective increase of hardness is available. On the other hand, if C content is higher than 2%, the alloy becomes so hard as to cause scuffing of a member co-operating with the rocker arm. Therefore, C content should be in the range 0.5%–2%.

Cr, Mo and W generate carbides and borides by being combined with C and B, respectively. If the amount of these elements is less than 2%, no effective increase of hardness is available, while if it increase beyond 8%, moldability by welding of the alloy becomes poor. Therefore, the amount of these carbide and boride forming elements should be in the range 2%–8%.

Finally, it is also important that the amount of Fe should be in the range 30%–60%. Fe is indispensable for generating Ni-Fe silicides, while it is one of the base materials of the alloy, and is less expensive than the other base material, i.e. Ni. Table 1 shows a result of experiments performed in order to confirm the effect of Fe content in the alloy of the present invention. These results were obtained by varying the Fe content from 10%–70% in an alloy which contained 8.5% Si, 1.0% C, 5.0% Cr, and the balance Ni. If Fe increases beyond 60%, silicides generated in the alloy becomes richer in Fe-silicide, whereby the alloy becomes harder but undesirably more brittle, and causes heavy wearing of itself as well as the co-operating member. On the other hand, if Fe decreases below 30%, although the impact value of the alloy increases, its wear resistance unduly decreases. Therefore, in view of its own characteristics, and in view of balancing the desirable amount of Ni, the Fe content should be approximately 30%–60%.

BRIEF DESCRIPTION OF THE DRAWINGS

The present invention will become more fully understood from the detailed description given hereinbelow and the accompanying drawings and photographs, which are given by way of illustration only and thus are not limitative of the present invention, and wherein.

DESCRIPTION OF THE PREFERRED EMBODIMENTS

EXAMPLE 1

First some wear resistant alloys which were disclosed in the parent application Ser. No. 970,968, now abandoned, and give the basis to the present invention will be described, in order to establish the background to the present invention, and to explain the reasons for the percentages claimed for elements other than B.

Alloys were prepared by changing the Si content in the range of 3.0%–14.0%, in an alloy which also contained 44.1% Ni, 1.0% C, 5.1% Cr, and balance Fe. The alloys were examined by a microscope. As a result, it was found that the alloys were composed of silicides of Ni and Fe, chromium carbide, and Fe-Ni-Si base. In more detail, if Si content is increased, more silicides (having micro-Vicker's hardness of 800–900) are formed, whereby wear resistance is improved, while the alloy becomes brittle. On the contrary, if Si content is decreased, formation of silicides is reduced, whereby wear resistance deteriorates in spite of the existence of carbides.

Figure 3A:
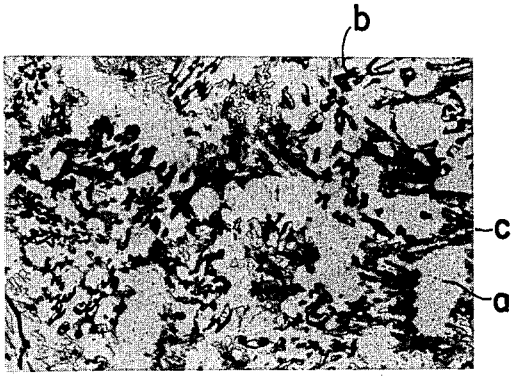
FIGS. 3*a*, 3*b*, and 3*c* are microphotographs of several alloys which give the basic to the present invention, for explaining proportions of Si in the alloy of the present invention.
Figure 3B:
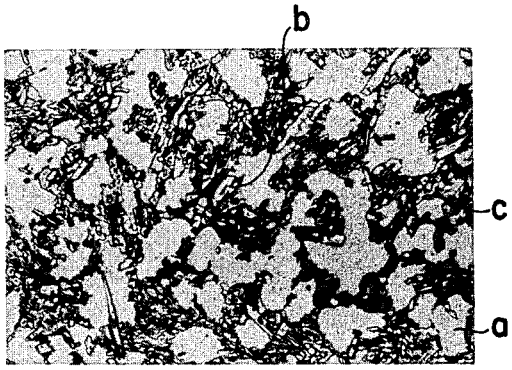
Figure 3C:
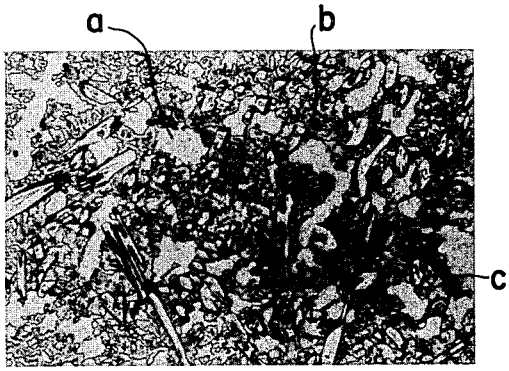

The microphotographs of FIGS. 3*a*, 3*b*, and 3*c* show the structures of the above alloys including 4%, 6%, and 8% of Si, respectively. The magnification of these photographs is 400. In accordance with EPMA, it was found that portions (a) were phases of solid solution of Fe-Ni-Si-Cr having a relatively low micro-Vicker's hardness such as 380–460, that portions (b) were carbides having hardness of 1100–1500, and that portions (c) were silicides of nickel and iron having hardness of 800–900. When the alloy's Si content is 4% (photograph FIG. 3*a*) its silicide content is relatively low, as 15%–25% (surface ratio) and its hardness is also low, such as lower than 500. When its Si content increases to 6% (photograph 3*b*) and to 8% (photograph 3*c*) its silicide content increases to 25%–45% and 30%–65% respectively, and its hardness also increases to above 550 and above 600, respectively.

Table 2 shows a result of experiments with regard to the relation of silicide content and wear resistance to Si percentage. From these results, it is noted that increase of Si content increases formation of silicide, improves wear resistance, but causes brittleness, while decrease of Si content decreases the formation of silicides, improves impact resistance, but worsens scuff and wear resistance.

From the test results, it is noted that wear of the alloy slightly increases when its Si content is reduced down to 6% and abruptly increases when its Si content is reduced to below 4%. If Si content is above 6%, the value of Si content has no substantial effect on wear. However, when Si content increases beyond 10%, silicide content increases above 85%, and further when Si content becomes 14%, the alloy is almost completely composed of silicides, thereby causing difficulty with regard to grindability. Wear resistance is largely influenced by silicides, and it is desirable that silicide content should be above 15%, particularly between 25%–75%.

The effect of Si content in such an alloy was tested with regard to the relation between impact value and hardness. Table 3 shows the results of the test. From these results, it is clear that impact value becomes higher when Si content lowers. When Si content increases, hardness also increases while impact value lowers, thereby making cracks more liable to occur.

EXAMPLE 2

In order to make clear the effect of variation of the amount of carbide in the alloys of Example 1, three kinds of alloys were prepared to have compositions: 44.1% Ni—8% Si—balance Fe, 44.1% Ni—8% Si—5.1% Cr—1.0% C—balance Fe, and 44.1% Ni—8% Si—5.1% Cr—2.0% C—balance Fe. Hardness of these alloys was tested and found to be in the range 56–58 by Rockwell C scale. The hardness thus obtained showed the tendency of increasing slightly when C content increased. However, it was noted that C content did not contribute very much to the hardness. On the other hand, if C conent increases beyond 2%, the amount of polygonal carbide increased, thereby enhancing the tendency of causing scuffing of co-operating members.

EXAMPLE 3

These above-described alloys can be used for casting, weld-padding, sintering, weld-spraying, etc.. In any event, it is desirable that the melting point of the alloy should be low, in view of workability and energy economy. According to the present invention, it was found that the melting point of such wear resistance alloys as described above was lowered by adding B thereto. In fact, by adding 1.5% of B to the alloy of 44.1% Ni—8.0% Si—5.1% Cr—1.0% C—40.3% Fe described in Example 2, the melting point lowered by about 100°–120° C. When B was added to the aforementioned alloy in amounts of 1.0%, 3.0%, and 5.0%, respectively, it was found that, when more than 3% of B was added, more borides were formed than silicides, and accordingly scuff resistance lowered. Furthermore, it was found that B is effective for lowering melting point only when it does not exceed 4%, while if it exceeds 4%, the melting point rather rises.

EXAMPLE 4

In order to see the effect of B on the hardness, moldability, and grindability of the alloy, we prepared alloys by changing B content from zero to 4% while maintaining the condition of 44.1% Ni—7% Si—1.0% C—5.1% Cr—balance Fe, and tested them. Table 4 shows the results of the test. If B content is lower than 0.3%, self-fluxing characteristic becomes poor, thereby deteriorating moldability of the alloy. If B content is higher than 4%, borides content becomes undesirably high, thereby causing cracks and deteriorating grindability. In view of these facts, it is desirable that B content should be in the range 0.5%—3%.

EXAMPLE 5

Atomizing powder having grains of smaller than 100 mesh of 1.5% C—8.2% Si—1.0% B—5.1% Cr—44.5% Ni—balance Fe was sprayed by means of a thermospray process employing hydrogen—oxygen gases onto the pad face of a rocker arm to the thickness of 1.0–1.2 mm, said pad face having been beforehand treated by the processes of degreasing—rinsing—drying—shotblasting. The sprayed layer was kept in a vacuum furnace having the conditions of 1020° C.–1030° C. and 0.01 mm Hg for 20–30 minutes and thereafter was cooled down in air. The pad face thus formed showed a good appearance and sectional structure free from any hanging portion, exfoliated portion, or other undesirable features.

The grain size of the powder and the spray and fusing conditions have an effect on the condition of the surface and the sectional structure of the coated layer. In more detail, when the grain size is large, the sprayed layer becomes perforated and shows poor pitting resistance. On the other hand, if the grain size is too small, the yield rate of the material in the powder making process is too small, thus increasing the cost of making the powder. Further, the time required for spraying becomes longer, and exfoliation is more liable to occur. Judging from the results of the test, grain size of 100 mesh to 20 microns is desirable. However, in order substantially to reduce perforations in the coated layer, it is more desirable to employ grain size of 200 mesh-20 microns.

The temperature condition for fusing was also examined. Temperatures lower than 950° C. are liable to cause unfused portions, while temperatures higher than 1040° C. are liable to cause hanging down of the surface. In view of this, temperatures between 960° C.-1040° C. are desirable.

With regard to the atmosphere for fusing, in view of the face that the alloy includes a large content of Fe and that perforations exist in the coated layer, an inactive atmosphere, a reducing atmosphere, or vacuum is desirable.

EXAMPLE 6

Figure 1:
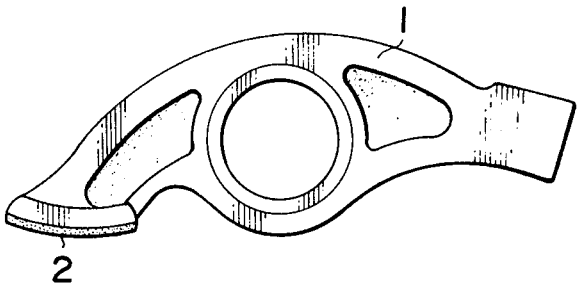
FIG. 1 is a side view of a valve rocker arm having a typical structure.
Figure 2:
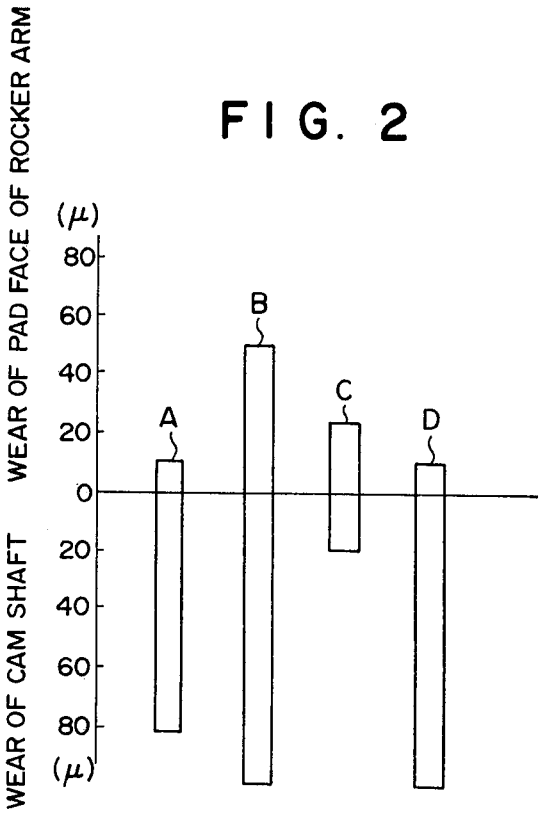
FIG. 2 is a graph showing comparison of a conventional material for a valve rocker arm and the alloy of the present invention with regard to wear resistance.

Rocker arms were prepared to have the pad faces formed by hard chromiun plating (A), by padding of chilled cast iron FC 30 (B), by padding of a nickel base self-fluxing alloy (D), and by padding of the wear resistant alloy of the present invention (C), and were assembled in the cam mechanism of an overhead cam engine rebuilt to be driven by an electric motor for the purpose of testing wear resistance of these pad faces. The wear resistant alloy of the present invention had the composition of 44.5% Ni—8.2% Si—1,0% B—1.5% C—5.1% Cr—balance Fe. The testing conditions were as follows: Engine rotational speed: 600 rpm, contact surface pressure: 70 kg/mm$^2$; material of co-operating member (i.e., camshaft): chilled cast iron; lubricating oil: Castle SAE 10W-30; temperature of lubricating oil: 80° C.; test duration: 1000 hours. The results of the test are shown in FIG. 2, wherein bars A, B, C, and D show wear of the pad faces of the aforementioned kinds A, B, C, and D, respectively. As apparent from this figure, although the alloy of the present invention is slightly inferior to the conventional nickel base self-fluxing alloy and chromium plating with regard to its own wear, it is superior to these conventional materials with regard to the wear of the co-operating member, so that the wear of the co-operating member is reduced to about one third. When compared with the chilled FC30 cast iron, the alloy of the present invention is superior to this with regard to both its own wear and that of the co-operating material. From the foregoing, it will be appreciated that the wear resistant alloy of the present invention has very improved characteristics with regard to its own wear as well as with regard to the wear of the co-operating member.

Although the invention has been shown and described with reference to some preferred embodiments thereof, it should be understood that various changes and modifications can be made therein by one skilled in the art, without departing from the scope of the invention, which it is therefore desired should be defined solely by the appended claim.

TABLE 1

| Fe % (by wt.) | Hardness (Vicker's) | Impact value (kg . m/cm$^2$) | Wear (rubbing test) Area of wear of itself (mm$^2$) | Wear of rubbing member (mg) | Remarks |
|---|---|---|---|---|---|
| 10 | 450–500 | 0.35 | 14.30 | 0.95 | heavy wear of itself |
| 20 | 470–500 | 0.35 | 10.10 | 0.45 | considerable wear of itself |
| 30 | 500–520 | 0.30 | 8.82 | 0.20 | good wear resistance |
| 50 | 580–630 | 0.28 | 8.86 | 0.20 | good wear resistance |
| 60 | 660–680 | 0.23 | 9.10 | 0.25 | good wear resistance |
| 70 | 680–700 | 0.15 | 12.50 | 1.25 | heavy wear of itself and rubbing member poor workability poor grindability |

Test conditions:
Rotational speed: 3400 rpm
Rubbing member: 30$^{\phi}$ × 5mm chilled cast iron
Load: 35 kg
Time: 5 hours
Oil: Spindle oil (at 70°)

TABLE 2

| Si % (by weight) | Silicide content % (surface ratio) | Wear (rubbing test) Area of scar (mm$^2$) | Wear of rubbing member (mg) | Remarks |
|---|---|---|---|---|
| 14 | almost 100 | 8.95 | 0.2 | poor grindability |
| 12 | 65–90 | 8.83 | 0.18 | relatively poor grindability |
| 10 | 55–85 | 8.80 | 0.2 | good grindability |
| 8 | 30–65 | 8.85 | 0.2 | good grindability |
| 6 | 25–45 | 8.92 | 0.2 | good grindability |
| 4 | 15–25 | 11.00 | 0.9 | slight scruffing |
| 3 | below 15 | 15.32 | 2.7 | scruffing and wear of rubbing member |

Test conditions:
Rotational speed: 3400 rpm
Rubbing member: 30$^{\phi}$ × 5mm chilled cast iron
Load: 35 kg
Time: 5 hours
Oil: Spindle oil (at 70° C.)

TABLE 3

| Si % | Hardness (Vicker's) | Impact value kg-cm/cm$^2$ |
|---|---|---|
| >12 | >700 | 0.1–0.25 |
| 12 | >700 | 0.1–0.25 |
| 10 | -700 | 0.2–0.25 |
| 8 | 600- | 0.27–0.32 |
| 6 | 550- | 0.37–0.48 |
| 4 | 400- | 0.46–0.60 |
| <4 | <400 | 0.60- |

TABLE 4

| B % | Hardness (Vicker's) | Moldability | Grindability |
|---|---|---|---|
| 0 | -500 | poor | good |
| 0.3 | -510 | poor | good |
| 0.5 | 520-560 | good | good |
| 1.0 | 540-600 | good | good |
| 2.0 | 580-630 | good | good |
| 3.0 | 600-650 | good | good |

TABLE 4-continued

| B % | Hardness (Vicker's) | Moldability | Grindability |
|---|---|---|---|
| 4.0 | 650- | good | poor |

We claim:

1. A wear-resistant alloy consisting essentially of about 30%-60% Ni, 6%-10% Si, 0.5%-3% B, 0.5%-2% C, 2%-8% of carbide and boride forming elements selected from the group consisting of Cr, Mo, and W, and 30%-60% Fe.

* * * * *